US006120305A

United States Patent [19]

Crestin

[11] Patent Number: 6,120,305

[45] Date of Patent: Sep. 19, 2000

[54] ELECTRIC CONTACT WITH ELASTIC RETURN

[75] Inventor: Joseph Crestin, Vanves, France

[73] Assignee: Societe d'Exploitation des Procedes Marechal (SEPM), Saint-Maurice, France

[21] Appl. No.: 09/119,977

[22] Filed: Jul. 21, 1998

[30] Foreign Application Priority Data

Jul. 22, 1997 [FR] France ..... 97 09274

[51] Int. Cl.[7] ..... H01R 4/66

[52] U.S. Cl. ..... 439/98; 439/101; 439/248

[58] Field of Search ..... 439/92, 95, 98, 439/99, 101, 108, 246, 247, 248

[56] References Cited

U.S. PATENT DOCUMENTS

| | | | |
|---|---|---|---|
| 4,361,372 | 11/1982 | Majkrak et al. | 439/98 |
| 4,711,510 | 12/1987 | Orlando, Jr. | 439/246 |
| 4,790,765 | 12/1988 | Ehrenfels et al. | 439/96 |
| 5,491,766 | 2/1996 | Huynh et al. | 385/100 |
| 5,679,032 | 10/1997 | Auclair | 439/793 |
| 5,769,652 | 6/1998 | Wider | 439/248 |

FOREIGN PATENT DOCUMENTS 0643444 3/1995 European Pat. Off. .

*Primary Examiner*—Lincoln Donovan
*Attorney, Agent, or Firm*—Greenblum & Bernstein, P.L.C.

[57] ABSTRACT

A electric contact with elastic return comprising a contact head (2) that is fixed to the end (1') of an electric cable (1) or similar and is acted upon by the end of an elastic strip (3), the other end of which called the attachment end being fixed in the housing (6) of a device to be equipped. The contact according to the invention is remarkable particularly in that an area (1") of the cable (1) called the anchorage area, is fixed to the said device housing (6) close to the strip attachment end, and in that the cable (1) is in the shape of a hook (1'") between its anchorage area (1") and its end (1') fitted with the contact head (2), delimiting a free space in its concave curved part, whereas the contact head (2) has a contact surface (2*c*) placed perpendicularly to the longitudinal axis of the cable end (1') and is free to move elastically approximately coaxial with the said axis, the strip (3) being formed in the said free space also being acted upon by a spring (11) fixed to the device housing (6).

24 Claims, 2 Drawing Sheets

ELECTRIC CONTACT WITH ELASTIC RETURN

BACKGROUND OF THE INVENTION

1. Field of the Invention

The invention relates to an electric contact with an elastic return designed to be fitted on the end of a cable.

2. Description of Background and Relevant Information

Elastic pressurized electric contacts at the end of a cable are well known.

They comprise a contact head that bears elastically on an opposing contact under the action of an helical spring that surrounds a deformable conductor such as a braid, connected to a cable, possibly through a terminal or connection lug.

Apart from problems inherent to repeated deformations of the deformable conductor, these known contacts require a relatively large housing space between the end of the cable and the contact head.

This may become a disadvantage, depending on the device to be equipped, for example when the cable is not longitudinally in line with the contact head, but is inclined to it.

In particular to solve the dimensional problem mentioned above, the same author has written a document EP 0 643 444 A describing how to make an electric contact with an elastic return comprising a contact head fixed at the end of an electrical or similar cable and which is acted upon by the end of an elastic strip, the other end being called the attachment and fixed into the housing of a device to be equipped.

SUMMARY OF THE INVENTION

However, particularly to make a firmer contact attachment, to provide better guidance and good positioning of the contact head, better anchorage of the cable and particularly a structure releasing a greater length of free and therefore flexible cable within a restricted volume, the invention proposes a contact of the type mentioned above but which is particularly remarkable in that an area of the cable, called the anchorage area, is fixed to the device housing close to the strip attachment end, and in that the cable is in the shape of a hook between its anchorage area and its end fitted with the contact head, delimiting a free space in its concave curved part, whereas the contact head has a contact surface placed perpendicular to the longitudinal axis of the cable end and is free to move elastically approximately coaxial with the axis, the strip being formed in the free space also being acted upon by a spring fixed to the device housing.

Thus, deformations of the component strands of the cable are small due to the positioning of the contact head which moves longitudinally with respect to the end of the cable rather than perpendicularly as previously, as mentioned above.

Furthermore, the spring now acts on the spring rather than directly on the contact head.

Advantageously, the spring that acts on the strip is a helical spring installed coaxially on a guide rod that passes through the strip and is fixed to the device housing, the spring being fixed between the strip and an end stop of the rod which preferably passes through an oblong hole in the strip formed close to the end of the strip acted upon by the contact head.

According to one embodiment, the contact head comprises a sleeve that covers the end of the cable.

Preferably, the strip is fixed to the contact head by a fork shape end designed to be housed in one or more grooves formed in the contact head for this purpose, and partially surrounding it.

For example, the cable may be fixed in the device housing using screws that are fixed in the housing and which pass through the cable.

Advantageously, the strip has a central opening in the middle part close to its attachment end, and its profile has the form of a crank.

According to one application, this type of contact may for example be used to equip a mobile connector of a connection system, and particularly the connector in a charging connection.

BRIEF DESCRIPTION OF THE DRAWINGS

The invention will be better understood, and other special features will become obvious by reading the following description with reference to the drawings in which.

DETAILED DESCRIPTION OF THE INVENTION

Figure 1:
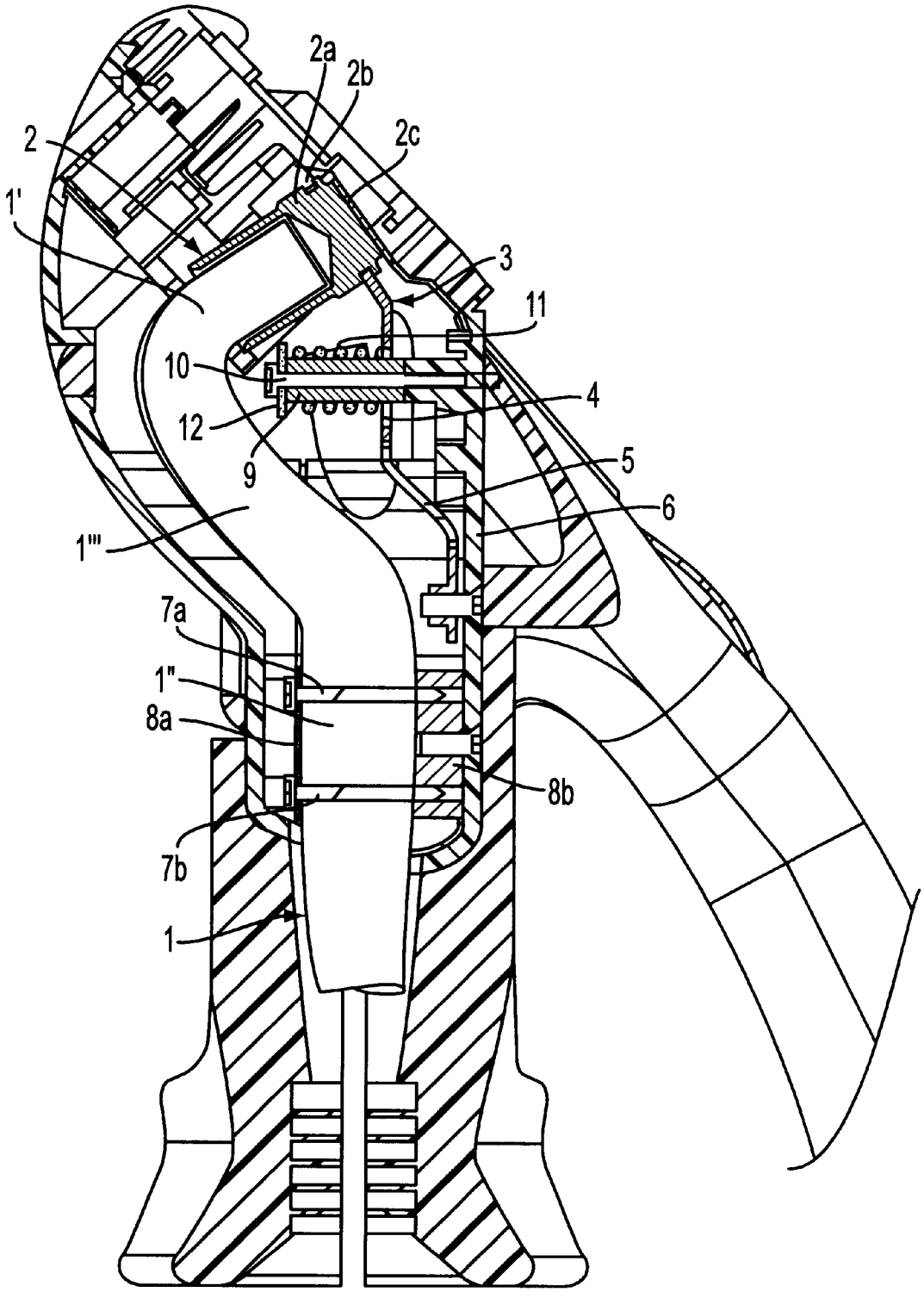
FIG. 1 shows a section along I—I in FIG. 2 through a mobile connector fitted with at least one contact according to the invention.

The example shown in the drawings is a mobile connector comprising several contacts according to the invention, for example for use to make power contacts.

Each contact is designed to be formed in the end 1' of a cable 1 (FIG. 1) and comprises a contact head 2 in this case in the form of a sleeve 2*a* that covers the end of the cable and which includes a disk 2*c*, for example made of silver, designed to form the electric contact with a corresponding contact in another device which with the connector will be coupled.

The disk 2*c* that forms the contact surface is placed perpendicular to the longitudinal axis of the end 1' of cable 1 and, as is obvious in FIG. 1, the head 2 is free to move approximately coaxially along the axis, in an elastic movement for reasons which will be described later.

Figure 2:
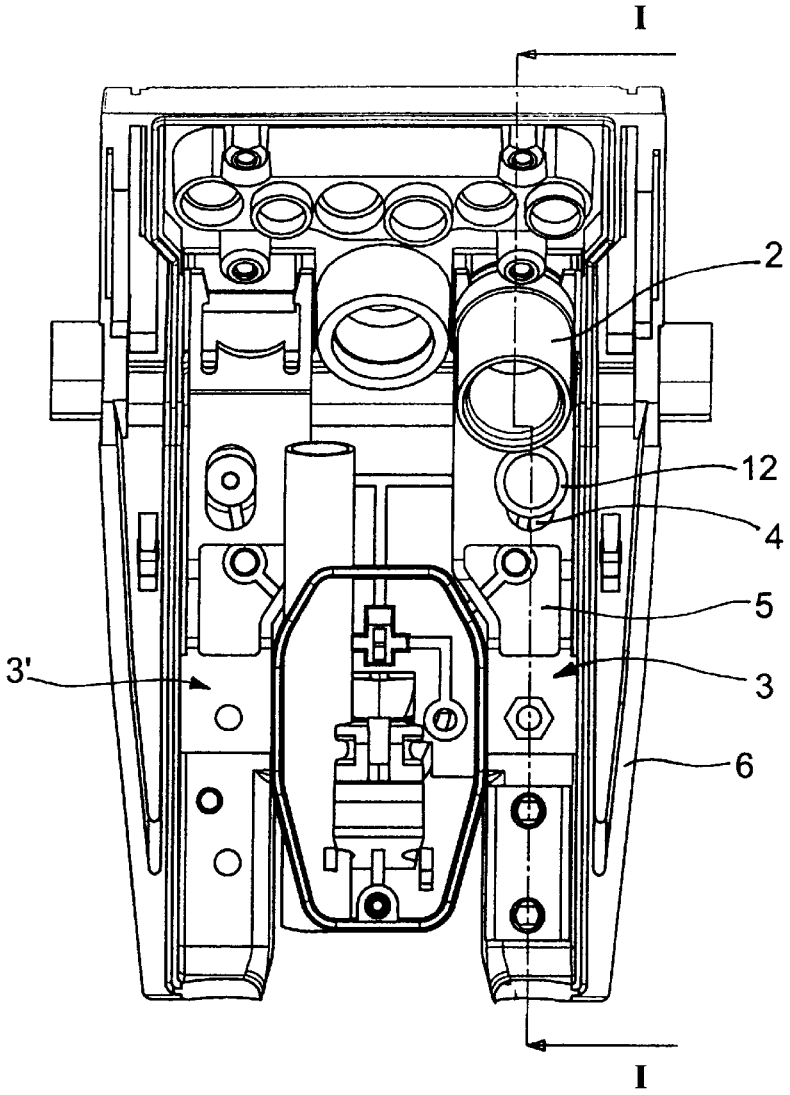
FIG. 2 is a partial view of in elevation of the open housing of the connector in FIG. 1, the cables having been removed to facilitate understanding.
Figure 3:
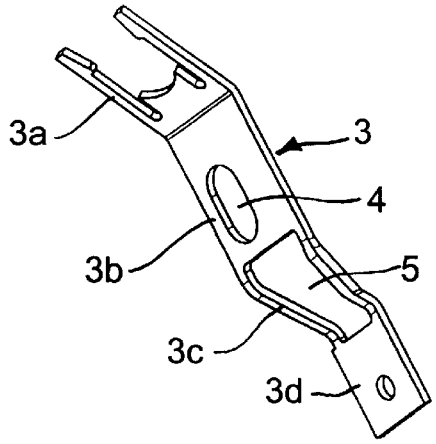
FIG. 3 is a perspective view of a strip used to make a contact according to the invention.

The contact head is fixed to a spring strip 3, as shown in FIGS. 1 to 3, FIG. 3 in particular showing the strip alone while FIG. 2 shows strip 3 and another strip 3' of the same type for another contact.

In order to attach the head 2 and the strip 3, the strip has one end in the form of a fork 3*a* designed to fit in a groove 2*c* in the contact head 2 by partially surrounding it.

As is clearly shown in FIG. 3, fork 3*a* in strip 3 has two elastic arms that are terminated by retaining pins that are forced through, the ends of the two arms then being tightened by a tool in order to give perfect attachment of contact head 2.

The general shape of strip 3, apart from its forked end 3*a*, is formed as crank with one end 3*d* called the attachment end opposite to the fork 3*a*, and an intermediate area in two parts, namely 3*b* on the side of the fork 3*a*, and 3*c* on the side of the attachment end 3*d*, parts 3*a*, 3*b*, 3*c* and 3*d* being connected to each other forming a zigzag. More particularly, the elastic strip is formed as a plurality of respective successive portions 3*a*, 3*b*, 3*c*, 3*d*, which extend generally along different successive planes.

As clearly shown in the figures, and particularly in FIG. 3, the intermediate part 3*b* includes an oblong hole 4, the length of which is parallel to the length of the strip, whereas part 3*c* includes an opening 5, located intermediate of the ends 3*a*, 3*d*, which is discussed below.

The strip 3 is fixed at its end 3*d* in the housing 6 of the connector shown in FIGS. 1 and 2, in this case using a screw and a nut.

As clearly shown in FIG. 1, the cable 1 is anchored in the device housing 6, in this case using screws 7*a*, 7*b* which pass through the cable 1 in an anchorage area 1" clamping it between two elements 8*a*, 8*b*, whereas the cable 1 is in the form of a hook 1"' between its anchorage area 1" and its end 1' fitted with the contact head 2.

As can be seen also in FIG. 1, strip 3 is located in the space delimited by the concave curved part 1"' of the cable 1.

It can also be seen that a rod 9 fixed to the housing 6 by a screw 10 passes through the oblong hole 4 in strip 3, whereas a helical spring 11 is fixed between the strip 3 and a stop washer 12 placed at the end of rod 9.

Consequently, it can be understood that the spring 11 moves the contact head 2 towards its connection position, through strip 3.

This arrangement gives the advantages mentioned above particularly concerning compactness, flexibility of the cable, and also perfect static positioning (position of the head with respect to the strip attachment) and dynamic positioning due to guidance partly provided by rod 9 in oblong hole 4.

Furthermore, it may be noted that the opening 5 results in some torsional flexibility which is useful in particular to compensate for tolerances in placing the contact head flat 2 on its opposing contact.

What is claimed is:

1. An electric contact device adapted to be affixed to an electrical conductor, said device comprising:

a contact head adapted to be connected to an end of an electrical conductor, said contact head having a contact surface;

an elastic strip having an attachment end and a contact head end, said contact head end of said elastic strip being attached to said contact head;

a housing having an electrical conductor attachment area within said housing for attaching a portion of the electrical conductor spaced from an end of the electrical conductor, said housing further comprising a free space for receiving a curved portion of said electrical conductor between said portion of the electrical conductor and the end of the electrical conductor;

said contact head being located in an area of said housing spaced from said electrical conductor attachment area;

said attachment end of said elastic strip being fixed to said housing and said contact head end of said elastic strip, connected to said contact head, being free to guide movement of said contact head in a direction substantially coaxially with a longitudinal axis of the end of the electrical conductor; and a spring located in said free space of said housing and applying a force to said elastic strip.

2. An electric contact device according to claim 1, wherein:

said free space of said housing is adapted to receive a concave portion of the curved portion of the electrical conductor and said spring extends into the concave portion of the curved portion of the electrical conductor.

3. An electric contact device according to claim 1, wherein:

said spring is a helical spring;

a guide rod having an end stop is affixed to said housing and extends through an opening in said elastic strip; and said helical spring is mounted coaxially on said guide rod and extends between said end stop of said guide rod and said elastic strip.

4. An electric contact device according to claim 3, wherein:

said opening of said elastic strip is an oblong hole, said oblong hole being formed closer to said contact head end of said elastic strip than to said attachment end of said elastic strip.

5. An electric contact device according to claim 1, wherein:

said contact head comprises a sleeve, said sleeve being adapted to cover the end of the electrical conductor.

6. An electric contact device according to claim 5, wherein:

said sleeve of said contact head includes an external surface and at least one peripherally extending groove in said external surface;

said contact head end of said elastic strip is fork-shaped, said forked-shaped end fitted into and partially surrounding at least of said at least one groove of said contact head.

7. An electric contact device according to claim 1, further comprising:

a plurality of screws fixed to said housing in said conductor attachment area for attaching the electrical conductor to said housing.

8. An electric contact device according to claim 1, wherein:

said elastic strip has an intermediate opening located closer to said attachment end of said elastic strip than to said contact head end of said elastic strip.

9. An electric contact device according to claim 1, wherein:

said elastic strip has a crank shape.

10. An electric contact device according to claim 1, wherein:

said elastic strip comprises a plurality of respective successive portions extending generally along different successive planes.

11. An electric contact device according to claim 1 in combination with said electrical conductor.

12. A mobile connector for a connection system comprising an electric contact device according to claim 1.

13. A n electric contact device comprising:

a contact head adapted to be connected to an end of an electrical conductor, said contact head having a contact surface, said contact surface extending perpendicularly with respect a longitudinal axis of the end of the electrical conductor;

an elastic strip having an attachment end and a contact head end, said contact head end of said elastic strip being attached to said contact head;

a housing having a conductor attachment area having a size and shape to have attached thereto an area of the electrical conductor spaced from the end of the conductor, said contact head being located in an area of said housing spaced from said conductor attachment area;

said housing further having a free space between said conductor attachment area and said area of said housing for said contact head for receiving a portion of said electrical conductor in the form of a hook;

said attachment end of said elastic strip being attached to said housing proximate to said conductor attachment area of said housing, said contact head end of said elastic strip facilitating elastic movement of said con tact head in a direction substantially coaxially with the longitudinal axis of the end of the electrical conductor; and a spring fixed to said housing and located in said free space of said housing and applying a force to said elastic strip.

14. An electric contact device according to claim 13, wherein:

said attachment end of said elastic strip being attached to said housing proximate to said conductor attachment area of said housing comprises said attachment end of said elastic strip and said conductor attachment area of said housing are on a single side of said housing with respect to said free space of said housing.

15. An electric contact device according to claim 13, wherein:

said spring is a helical spring;

a guide rod having an end stop is affixed to said housing and extends through an opening in said elastic strip; and said helical spring is mounted coaxially on said guide rod and extends between said end stop of said guide rod and said elastic strip.

16. An electric contact device according to claim 15, wherein:

said opening of said elastic strip is an oblong hole, said oblong hole being formed proximate said contact head end of said elastic strip.

17. An electric contact device according to claim 13, wherein:

said contact head comprises a sleeve, said sleeve adapted to cover the end of the electrical conductor.

18. An electric contact device according to claim 17, wherein:

said sleeve of said contact head includes at least one groove;

said contact head end of said elastic strip is fork-shaped, said forked-shaped end fitted into and partially surrounding at least of said at least one groove of said contact head.

19. An electric contact device according to claim 13, further comprising:

a plurality of screws fixed to said housing in said conductor attachment area for attaching the electrical conductor to said housing.

20. An electric contact device according to claim 13, wherein:

said elastic strip has an intermediate opening located proximate to said attachment end of said elastic strip.

21. An electric contact device according to claim 13, wherein:

said elastic strip has a crank shape.

22. An electric contact device according to claim 13, wherein:

said elastic strip comprises a plurality of respective successive portions extending generally along different successive planes.

23. A mobile connector for a connection system comprising an electric contact device according to claim 22.

24. An electric contact device according to claim 13 in combination with said electrical conductor.

* * * * *